US007244071B2

(12) United States Patent
Harada

(10) Patent No.: US 7,244,071 B2
(45) Date of Patent: Jul. 17, 2007

(54) PRINTER, AND PRINT MEDIUM CARTRIDGE USED FOR THE PRINTER

(75) Inventor: Hironori Harada, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 28 days.

(21) Appl. No.: 10/480,199

(22) PCT Filed: Jun. 7, 2002

(86) PCT No.: PCT/JP02/05711

§ 371 (c)(1),
(2), (4) Date: Dec. 30, 2003

(87) PCT Pub. No.: WO02/100649

PCT Pub. Date: Dec. 19, 2002

(65) Prior Publication Data

US 2004/0161278 A1 Aug. 19, 2004

(30) Foreign Application Priority Data

Jun. 11, 2001 (JP) ..... 2001-175994

(51) Int. Cl.
*B41J 11/00* (2006.01)

(52) U.S. Cl. ..... 400/613; 400/615.2; 400/621; 400/248

(58) Field of Classification Search ..... 400/234, 400/242, 247, 88, 207, 615.2, 613, 208, 248; *B41J 3/36, B41J 15/04*

See application file for complete search history.

(56) References Cited

U.S. PATENT DOCUMENTS

| | | | | |
|---|---|---|---|---|
| 5,183,333 | A * | 2/1993 | Minowa | 400/605 |
| 5,253,334 | A * | 10/1993 | Kimura et al. | 358/1.2 |
| 5,313,257 | A | 5/1994 | Kashima et al. | |
| 5,383,731 | A | 1/1995 | Hattori et al. | |
| 6,116,796 | A | 9/2000 | Yamaguchi et al. | 400/615.2 |

FOREIGN PATENT DOCUMENTS

| | | |
|---|---|---|
| JP | A 7-89196 | 4/1995 |
| JP | A 7-144437 | 6/1995 |
| JP | A 8-25706 | 1/1996 |
| JP | A 11-170624 | 6/1999 |
| JP | A 2000-43338 | 2/2000 |
| JP | A 2001-278510 | 10/2001 |

* cited by examiner

*Primary Examiner*—Daniel J. Colilla
*Assistant Examiner*—Marissa Ferguson-Samreth
(74) *Attorney, Agent, or Firm*—Oliff & Berridge, PLC

(57) ABSTRACT

A tape printer (100) capable of, as necessary, installing, therein, a print medium cartridge for storing print medium of different lengths, wherein a cartridge storage area (120) is formed in the tape printer (100) by recessing inward the surface of the printer. The size of the cartridge storage area (120) is so formed that a larger cartridge (200) in a contour shape wider than a standard cartridge (1) can be installed therein. A fixed print head (102) and drive shafts (100*a*, 100*b*) are disposed on the bottom surface of a cartridge installation part (140).

29 Claims, 11 Drawing Sheets

PRINTER, AND PRINT MEDIUM CARTRIDGE USED FOR THE PRINTER

TECHNICAL FIELD

The present invention relates to a printer and a print medium cartridge that contains a strip-shaped print medium in a state wound and is configured to be installed in the printer.

BACKGROUND ART

A conventional strip-shaped print medium (e.g., print tape) is often wound and contained in a print medium cartridge. Such a print medium cartridge is configured to be installed in a printer having a printing head. A user of the printer can select a print medium cartridge containing a print medium having a specific width to install it into the printer. Assume that print medium having different widths need to be used with respective cartridges that are different from each other. Then, the cartridges can be formed on the same basic design concept if they are made to have a large height as viewed in the winding direction of the print medium, although the widths of the print medium contained in the respective cartridges may be different from each other. As a result, alterations that need to be made to the design of the cartridge for containing a print medium having a specific width can be minimized, if necessary. Therefore, as general practice, the cross sections of cartridges for containing print medium having different widths as taken in a direction perpendicular to the axis of winding of the print medium are made to show a substantially same contour.

Thus, printers are designed to have an inner space for mounting a print medium cartridge on the assumption that the cross sections of cartridges containing respective print medium having different widths are made to show the substantially same contour for the purpose of downsizing the printers, although the widths of the print medium may be taken into consideration.

However, as a result of making the cross sections of print medium cartridges show the same contour, the size of the print medium is subjected to limitations when it is wound up due to the contour of the cross section (the radius of the wound print medium). Then, the length of the print medium needs to be limited. Besides, cartridges are made to have an only limited space for containing the print medium in the inside as a result of the efforts paid for downsizing the printer and the print medium cartridge. Therefore, the length of the wound print medium is limited also for this reason. Thus, the print medium cartridge needs to be replaced frequently when a printing operation needs to be conducted on a large scale.

Therefore, it is an object of the present invention to provide a printer for which the user can select one of print medium cartridges containing respective print medium having different lengths or different thickness per unit length and in which the user can install the selected print medium, and also a print medium cartridge that can be used with such a printer.

Another object of the present invention is to provide a printer in which some different kinds of print medium cartridges can be installed.

Still another object of the present invention is to provide an non-standard cartridge that can be installed in a printer in place of a standard cartridge.

DISCLOSURE OF THE INVENTION

The present invention provides a printer that selectively installs a first print medium cartridge containing a first print medium in a wound state and a second print medium cartridge containing a second print medium in a wound state to print on the first and second print mediums. Both of the print mediums are strip-shaped. The second print medium has either one of a longer length and a thicker thickness per unit length than the corresponding one of those of the first print medium. The second print medium in the wound state has a different outline of a cross section perpendicular to a winding axis thereof from that of the first print medium in the wound state. The printer has a printing head that prints on the print medium; a print medium drive mechanism that moves the print medium relative to the printing head; and an installation section having a storage area that selectively installs either one of the first and second print medium cartridges. The printing head is arranged so as to print on the print medium in the one print medium cartridge installed in the storage area. The print medium drive mechanism is arranged so as to move the print medium contained in the one print medium cartridge installed in the storage area.

Thus, print medium cartridges having different contours of the cross section can be selectively installed in the storage area. Then, if necessary, it is possible to selectively install one of the print medium cartridges containing respective print medium having different length or different thickness in a wound state into the printer to improve the efficiency of printing.

The printer of the present invention further includes a detector provided in the installation section. The detector detects at least one of presence or absence of the print medium cartridge in the storage area, presence or absence of the print medium in the print medium cartridge if the print medium cartridge is stored in the storage area, and the type of the print medium. In this manner, the single detector can perform at least three types of different detection, the printer can be configured simply.

The printer of the present invention further includes cutting means provided on a side from which the print medium in the print medium cartridge installed in the storage area is ejected. The storage area extends in an opposite direction to the side of cutting means. With this arrangement, the storage area can be made wider because the design of the storage is not affected by an ejecting mechanism.

The present invention provides a printer that selectively installs a first print medium cartridge containing a first print medium in a wound state and a second print medium cartridge containing a second print medium in a wound state to print on the first and second print mediums, both of the print mediums being strip-shaped, the second print medium having either one of a longer length and a thinner thickness per unit length than the corresponding one of those of the first print medium, the second print medium in the wound state having a different outline of a cross section perpendicular to a winding axis thereof from that of the first print medium in the wound state. The printer includes a printing head that prints on the print medium; a print medium drive mechanism that moves the print medium relative to the printing head; and a installation section having a receiving section that selectively receives either one of the first and second print medium cartridges and an opening through which the one print medium cartridge in the receiving section is projected out. The printing head is arranged so as to print on the print medium in the one print medium cartridge received in the receiving section, and the print medium drive mechanism is arranged so as to move the print medium in the one print medium cartridge received in the receiving section.

Thus, print medium cartridges having different contours of the cross section are selectively received to the installation section.

The present invention provides a printer having; a first print medium cartridge that contains a first print medium in a wound state, the first print medium being strip-shaped; a second print medium cartridge containing a second print medium in a wound state, the second print medium being strip-shaped, the second print medium having either one of a longer length and a thicker thickness per unit length than the corresponding one of those of the first print medium, and the second print medium in the wound state having a different outline of a cross section perpendicular to a winding axis thereof from that of the first print medium in the wound state; and a printer main unit having a printing head that prints on the print medium, a print medium drive mechanism that moves the print medium relative to the printing head, and an installation section having a storage area to selectively install either one of the first and second print medium cartridges. The printing head is arranged so as to print on the print medium in the one print medium cartridge installed in the storage area, and the print medium drive mechanism is arranged so as to move the print medium in the print medium cartridge installed in the storage area.

Thus, print medium cartridges having different contours of the cross section are selectively installed in the receiving section. Therefore, if necessary, print medium cartridges containing respective print medium having different length or different thickness in a wound state can be selectively installed in the printer to improve the efficiency of printing operations.

The present invention provides a printer having a printing main unit and a standard cartridge installed into the printing main unit, the standard cartridge including a print medium, thereby printing on the print medium. The printing main unit has a printing head that prints on the print medium; a print medium drive mechanism having a first rotary shaft and a second rotary shaft rotating in synchronism with the second rotary shaft, thereby moving the print medium relative to the printing head. The standard cartridge has a rotatable standard spool around which the print medium is wound; a first roller configured to be engaged with the first rotary shaft to move the print medium; and a second roller configured to be engaged with the second rotary shaft; a center of the standard spool being separated from a center of the first roller by a first predetermined distance, and the center of the standard spool being separated from a center of the second roller by a second predetermined distance; the standard cartridge being replaceable with a non-standard cartridge. The non-standard cartridge has a rotatable non-standard spool around which the print medium is wound; a third roller configured to be engaged with the first rotary shaft to move the print medium; and a fourth roller configured to be engaged with the second rotary shaft; a distance (R1) between centers of the non-standard spool and the third roller being different from the first predetermined distance (r1), and a distance (R2) between centers of the non-standard spool and the fourth roller being different from the second predetermined distance (r2).

Preferably, the distance (R1) between the centers of the non-standard spool and the third roller is longer than the first predetermined distance (r1), and the distance (R2) between the centers of the non-standard spool and the fourth roller is longer than the second predetermined distance.

The present invention provides a print medium cartridge for containing a strip-shaped print medium in wound state and selectively-installable for a printer, the print medium being printed by a printing head in the printer and moved relative to the printing head by a print medium drive mechanism in the printer. The strip-shaped print medium has at least one of a longer length and thicker thickness per unit length than the corresponding one of those of another print medium in another print medium cartridge, an outline of a cross section of the print medium cartridge perpendicular to the winding axis of the print medium therein is different from that of the another print medium cartridge.

Thus, a print medium cartridge according to the invention and the another print medium cartridge can be selectively installed in the printer. The print medium cartridge can contain a print medium that has either one of longer length and thicker thickness than the corresponding one of those of the strip-shaped print medium contained in the another print medium cartridge.

The present invention provides a non-standard cartridge installable to a printer having a printing head for printing a print medium and a print medium drive mechanism, the non-standard cartridge being replaceable with a standard cartridge installable for the printer, the print medium drive mechanism including a first rotary shaft and a second rotary shaft that rotates in synchronism with the first rotary shaft to move the print medium relative to the printing head. The standard cartridge has: a rotatable standard spool around which the print medium is wound; a first roller configured to be engaged with the first rotary shaft to move the print medium; and a second roller configured to be engaged with the second rotary shaft; a center of the standard spool being separated from a center of the first roller by a first predetermined distance (r1), and separated from a center of the second roller by a second predetermined distance (r2). The non-standard cartridge has: a rotatable non-standard spool around which the print medium is wound; a third roller configured to be engaged with the first rotary shaft to move the print medium; and a fourth roller configured to be engaged with the second rotary shaft; a distance (R1) between centers of the non-standard spool and the third roller being different from the first predetermined distance (r1), a distance: (R2) between centers of the non-standard spool and the fourth roller being different from the second predetermined distance (r2). A radius of the print medium wound around the non-standard spool is different from a radius of the print medium wound around the standard spool of the standard cartridge.

Preferably, the distance (R1) between the centers of the non-standard spool and the third roller is longer than the first predetermined distance (r1), the distance (R2) between the centers of the non-standard spool (3*a*') and the fourth roller (7*b*) is longer than the second predetermined distance (r2), and the radius of the print medium wound around the non-standard spool is longer than the radius of the print medium wound around the standard spool of the standard cartridge.

BEST MODE FOR CARRYING OUT THE INVENTION

Now, the present invention will be described by referring to the accompanying drawings.

Preferred embodiments of a tape printer for printing on a print tape and a cartridge for containing a print tape in the inside that are adapted to be installed in a printer will be described by referring to the accompanying drawings. Throughout the drawings, expressions of directions including "front", "rear", "left", "right", "up" and "down" refer to the respective directions as indicated by arrows in the related drawings.

A tape printer according to the invention has a printing head for printing on a print medium and a drive roller for moving the print medium relative to the printing head. The printing head is a thermal head. After the thermal head prints reversal patterns on a print surface of a print tape, the printing surface of the print tape and the adhesive surface of a peeling-paper-carrying double face adhesive tape (designated as double face tape hereinafter), which carries peeling paper only on one of the opposite sides thereof, are bonded to each other under a pressure to produce a multilayer tape for a label.

Figure 1:
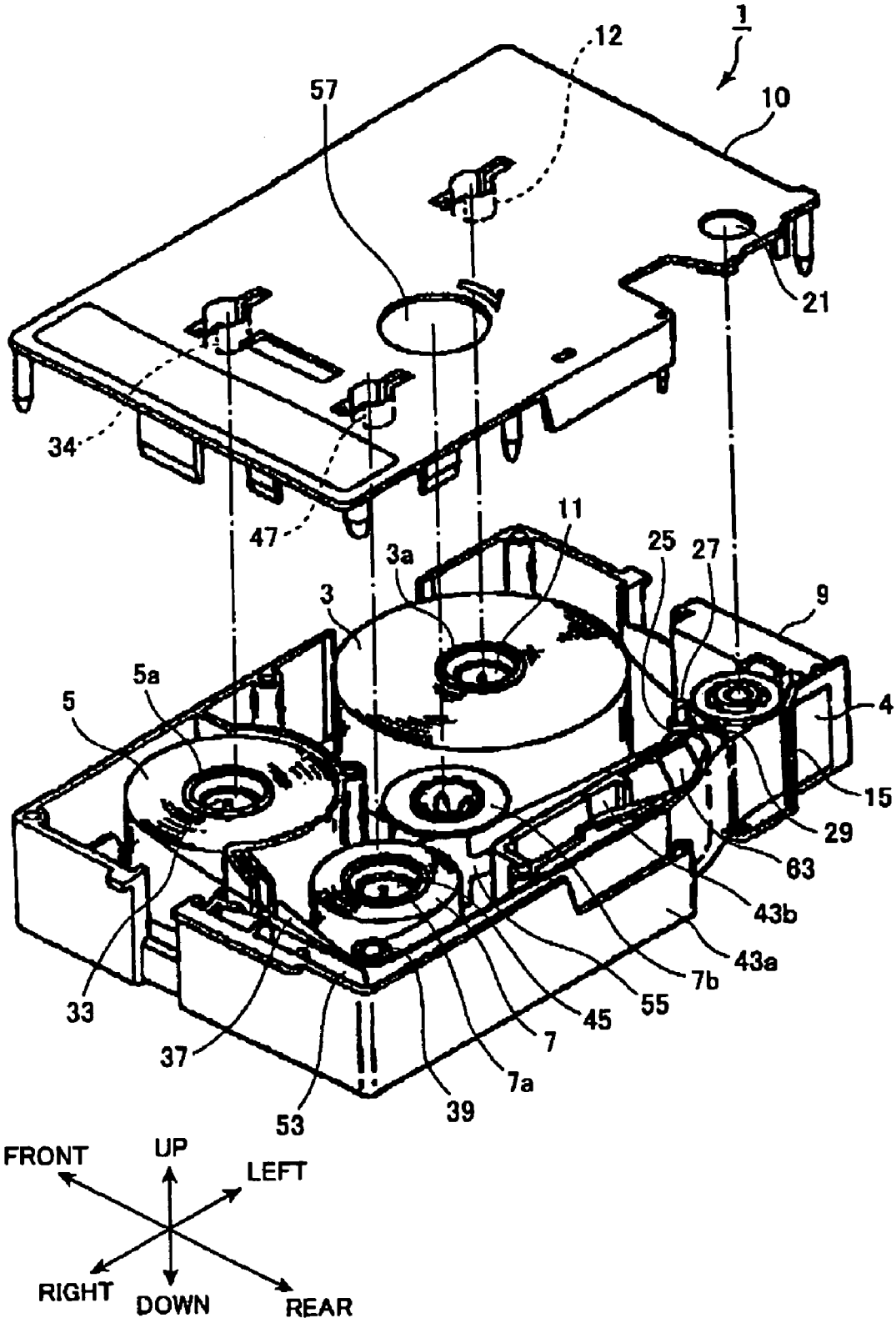
FIG. 1 is a perspective view of a standard print medium cartridge according to an embodiment of the present invention.
Figure 2:
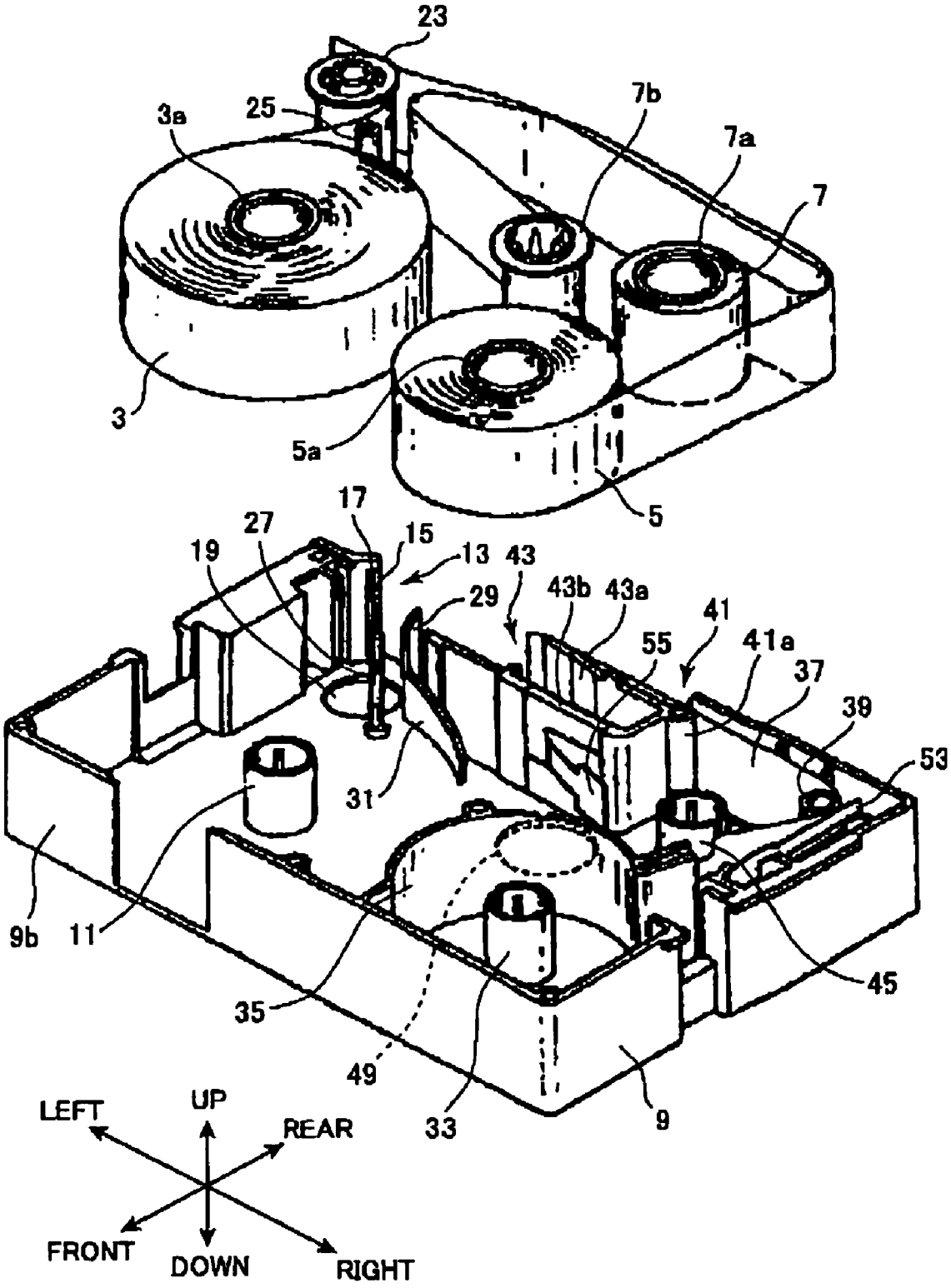
FIG. 2 is a perspective view of a standard print medium cartridge according to an embodiment of the present invention.

As shown in FIGS. 1 and 2, the cartridge 1 contains a double face tape 3 wound around a double face tape spool 3*a* with an adhesive surface of the tape 3 facing inside and the surface of the peeling paper on the tape facing outside. The cartridge 1 contains a print tape 5 wound around a print tape spool 5*a* and a thermal transfer ink ribbon (designated as ink ribbon hereinafter) 7 wound around a ribbon feed spool 7*a* with an ink surface of the ribbon 7 facing inside. The ribbon 7 is adapted to be wound around a flanged ribbon take-up spool 7*b* after each printing. The tape 5 and the ribbon 7 are arranged at respective positions in a cassette main body 9 having a bottom wall and lateral walls. The cassette main body 9A is provided with a lid 10 as a top wall of the cassette.

As shown in FIG. 2, the double face tape 3 is contained in a state where the tape 3 is wound around the double face tape spool 3*a*. The double face tape spool 3*a* is held in position by a hollow boss 11 projecting from the bottom wall of the cassette main body 9 and a boss 12 of the lid 10. The double face tape 3 is fed to the outside of the cartridge 1 by following the route as described below. The double face tape 3 is passed outside of the cartridge by feeding through an opening 13 where the tape is exposed to the outside and then a tape hole 17 defined by a tape holder 15 arranged on the outer peripheral surface of the upper lateral wall at a position located leftward relative to the feed out opening 13.

The double face tape 3 is curved along the outer peripheral surface of flanged tape feed roller 23, which is held with the opposite ends thereof in a support hole 19 bored through the bottom wall of the cassette main body 9 and a support hole 21 of the lid 10. And the peeling paper of the tape 3 faces an outer surface of the tape feed roller 23. The tape 3 then passes through a tape hole 17. A rotatable rubber-made guide roller 25 is attached around a guide pin 27 projecting from the bottom wall of the cassette main body 9. The roller 25 is held in contact with the adhesive surface of the double face tape 3 over the width thereof, when the double face tape comes out from the outer peripheral surface of the tape feed roller 23. The tape hole 17 has a wider width than those of the double face tape 3 and the print tape 5 so as to control the running of tapes 3 and 5.

An arc-shaped curved separator wall 29, which is coaxial with the support hole 19 and has a lot of ridges projecting from the inner peripheral surface thereof with sharp front edges, is standing up from the bottom wall of the cassette main body 9. An arc-shaped tape upper curved wall 31, which is coaxial with the boss 11, is connected to a lower edge of the separator wall 29. The wall 31 has a height from the bottom wall of the cassette main body 9 that gradually decreases toward the front end thereof.

The print tape 5 is contained in the cassette as it is wound around a print tape spool 5*a* that is held in position by a hollow boss 33 projecting upward at a position located rightward relative to the boss 11 and a boss 34 of the lid 10. The tape 5 is separated from the double face tape 3 by an arc-shaped print tape containing wall 35 provided around the print tape spool 5*a*. The print tape 5 is fed through the tape hole 17 to outside by a guide shaft 39, an upper slit 41, and an opening of a printing head insertion hole 43 along the outer peripheral surface of resin-made film separator 37, which is securely held in a U-shaped groove arranged at an end of the print tape containing wall 35. The separator 37 does not adhere ink.

The print tape 5 and the double face tape 3 are attached together on the outer peripheral surface of the tape feed roller 23 through the adhesive surface to produce a label tape 4, and fed out of the cartridge 1. The printing head insertion hole 43 is defined by a guide piece 43*a* extending from the boss 41*a* below the upper slit 41 toward the tape hole 17, and an L-shaped peripheral wall 43*b* extending from the boss 41*a*.

On the other hand, the ink ribbon 7 is contained in a manner as described below. The ink ribbon 7 is fed out from the ribbon feed spool 7*a* held in position by a boss 45 located rightward relative to the peripheral wall 43*b* and a boss 47 of the lid 10 to move along the inner peripheral surface of the separator 37 through the opening of the printing head insertion hole 43 and then turn its moving direction by about 180° at a front end of the peripheral wall 43*b*. Thereafter, the ribbon 7 passes between the lower surface of the peripheral wall 43*b* and the upper wall of the tape upper curved wall 31 to reach the ribbon take-up spool 7*b*. The spool 7*b* is held in lower support hole 49 located at a lower position relative to the peripheral wall 43*b* and support hole 51 of the lid 10.

At the guide shaft 39, the ink ribbon 7, the separator 37, and the print tape 5 are pressed against the guide shaft 39 in the above mentioned order by a press spring 55 fitted to the inner wall surface of the cassette main body 9. With this arrangement, the ink ribbon 7 and the print tape 5 are independently subjected to back tension forces.

The press spring 55 arranged on the lower surface of the peripheral wall 43*b* also acts on the ribbon take-up spool 7*b*, so that the ribbon take-up spool 7*b* cooperates with the press spring 55 to prevent the ink ribbon 7 from becoming loose before the cassette is installed in the tape printer 100.

The lid 10 is provided with projections that come into engagement respectively with corresponding holes of the cassette main body 9, and recesses arranged at the lateral walls of the cassette main body 9, so that the cassette main body 9 and the lid 10 are reliably aligned and secured with each other.

Now, how the cartridge 1 having the above described configuration is installed in the tape printer 100 and operates for printing will be described below by referring to FIG. 3.

To install the cartridge 1 into the tape printer 100, first, a tape feed roller drive shaft 100*a* and a ribbon take-up spool drive shaft 100*b* of the tape printer 100 are brought into engagement respectively with the tape feed roller 23 and the ribbon take-up spool 7*b* of the cartridge 1. Simultaneously, aligning projections 100*c*, 100*d* of the tape printer 100 are also brought into engagement respectively with long holes 57, 59 of the cartridge 1. And a cassette receiving piece 100*e* of the tape printer 100 is inserted into an insertion hole 61 of the cartridge 1. At this time, a fixed printing head 102 that is fixed to a predetermined position in the tape printer 100 moves into the printing head insertion hole 43 from the rear side of the cartridge 1 at the same time. The ink ribbon 7 is held to the side of the print tape 5 by a leaf spring 63 that is arranged on the upper surface of the peripheral wall 43*b* and pressed against the upper surface as the fixed printing head 102 moves. Therefore, the ink ribbon 7 is not hooked by the front end of the fixed printing head 102 when the fixed printing head 102 moves in.

Then, when an operator swings a roller holder 104 around a swing shaft 100*f* by means of a lever (not shown) arranged at the tape printer 100, a movable platen roller 106 and a drive roller 108 as tape conveying rollers partly move into the opening of a printing head insertion hole 43 and a feed out opening 13 of the cartridge 1. Through the opening 13, the tape is exposed to the outside.

As the movable platen roller 106 moves into the cartridge 1, the movable platen roller 106 overlays the print tape 5 on the ink ribbon 7 which are exposed to the outside through the opening of the printing head insertion hole 43. The movable platen roller 106 then pinches the print tape 5 and the ink ribbon 7 between the surface thereof and the end face 102*a* of the fixed printing head 102 where heat emitting elements are arranged.

At a downstream position thereof, the drive roller 108 is pressed against the outer peripheral surface of the tape feed roller 23 of the cartridge 1.

When the operator operates the tape printer 100 for the printing, the drive mechanism (not shown) in the tape printer 100 starts actuating to rotate the drive shafts 100*a*, 100*b*. At the same time, the heat emitting elements on the fixed printing head 102 start generating heat according to the printing pattern that is a reversal of the pattern to be printed by a printing drive circuit (not shown). The pattern is then printed on the rear surface of the print tape 5.

When the drive shaft 100*a* starts rotating, the tape feed roller 23 cooperates with the drive roller 108 to attach the printed surface of the print tape 5 onto the adhesive surface of the double face tape 3, thereby ejecting the multilayer tape 4 for a label out of the tape printer 100 through tape ejecting hole 100*g*. Accordingly, simultaneously with the ejecting operation, the print tape 5 and the double face tape 3*a* are pulled out from the spool 5*a* and the spool 3*a*, respectively.

Figure 4:
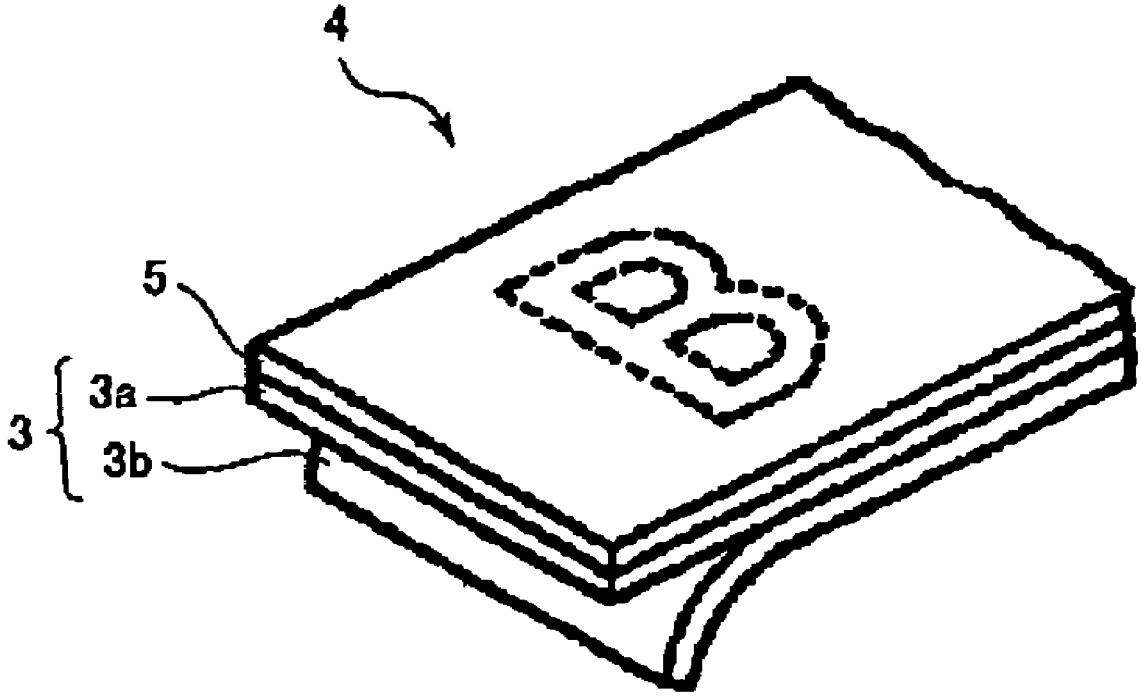
FIG. 4 is a perspective view of a printed tape according to an embodiment of printer according to the present invention.

The multilayer tape 4 formed from the double face tape 3 and the print tape 5 and ejected to the outside of the tape printer 100 typically has a configuration as shown in FIG. 4. Referring to FIG. 4, the rear surface of the transparent print tape 5 becomes a printing surface. The adhesive surface 3*a* of the double face tape 3 is bonded to the rear surface of the tape 5. The lowermost layer is the peeling paper 3*b* of the double face tape 5.

Figure 3:
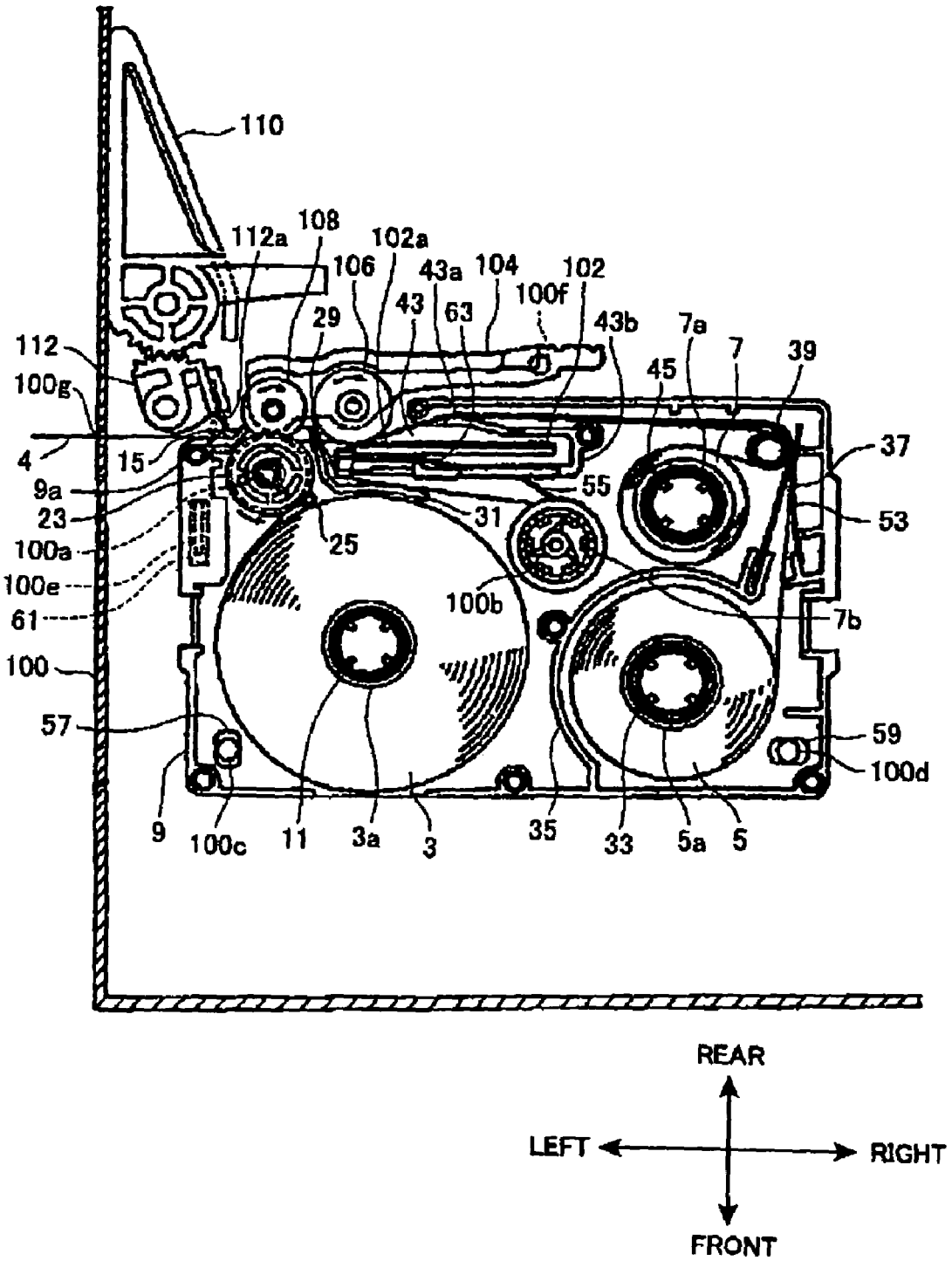
FIG. 3 is a perspective view of a standard print medium cartridge according to an embodiment of the present invention installed in a printer.

The multilayer tape 4 for a label is cut when a cutting lever 110 arranged in the tape printer 100 is turned in the direction of the arrow shown in FIG. 3 to rotate a rotary cutter 112 in the direction of the arrow and then press the edge 112*a* of the rotary cutter 112 against the outer surface 9*a* of the cassette main body 9 downstream relative to the tape hole 17 of the cartridge 1 as indicated by the broken line in FIG. 3. Subsequently, when the cutting lever 110 is released, the edge 112*a* rises and returns to the original position.

Figure 5:
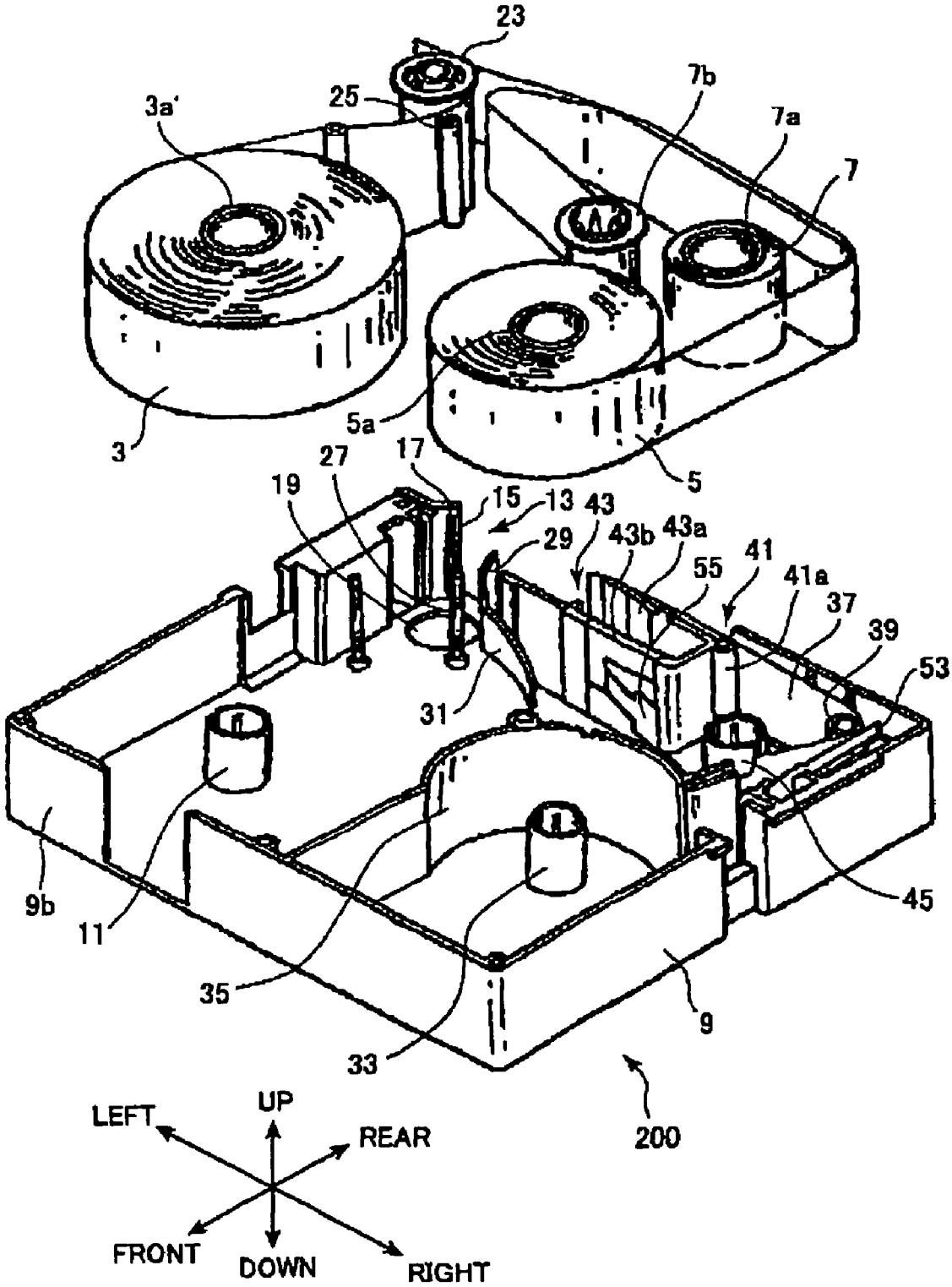
FIG. 5 is a perspective view of a large print medium cartridge according to an embodiment of the present invention.

There are two types of cartridges containing a strip-shaped double face tape 3 and a print tape 5 for forming a multilayer tape 4 for a label. One is the cartridge 1 (designated as standard cartridge 1 hereinafter) shown in FIGS. 1 and 2 . The other is the cartridge 200 (designated as larger cartridge 200 hereinafter) as shown in FIG. 5 that contains a double face tape 3 and a print tape 5 that are longer than their respective counterparts of the standard cartridge 1 or thicker per unit length than their respective counterparts of the standard cartridge 1 in a wound state. It is noted that the components of the cartridge 200 that have the same functions as those of their respective counterparts of the standard cartridge 1 have the same reference numbers, respectively.

The standard cartridge 1 and the larger cartridge 200 have the same width between the left and right ends thereof and the same height between the upper and lower ends thereof. Since the larger cartridge 200 needs to have a larger volume for containing a double face tape 3 and a print tape 5 (having a larger radius), the larger cartridge 200 is made to have a profile obtained by expanding the front part 9*b* of the standard cartridge 1 (in a leftward inclined direction)

Both the standard cartridge 1 and the larger cartridge 200 have elongated holes for receiving the aligning projections 100*c*, 100*d*. The elongated holes are commonly formed at the same positions in the both cartridges 1, 200. Thus, the aligning projections 100*c*, 100*d* cooperate both with the standard cartridge 1 and the larger cartridge 200 for alignment.

Figure 7A:
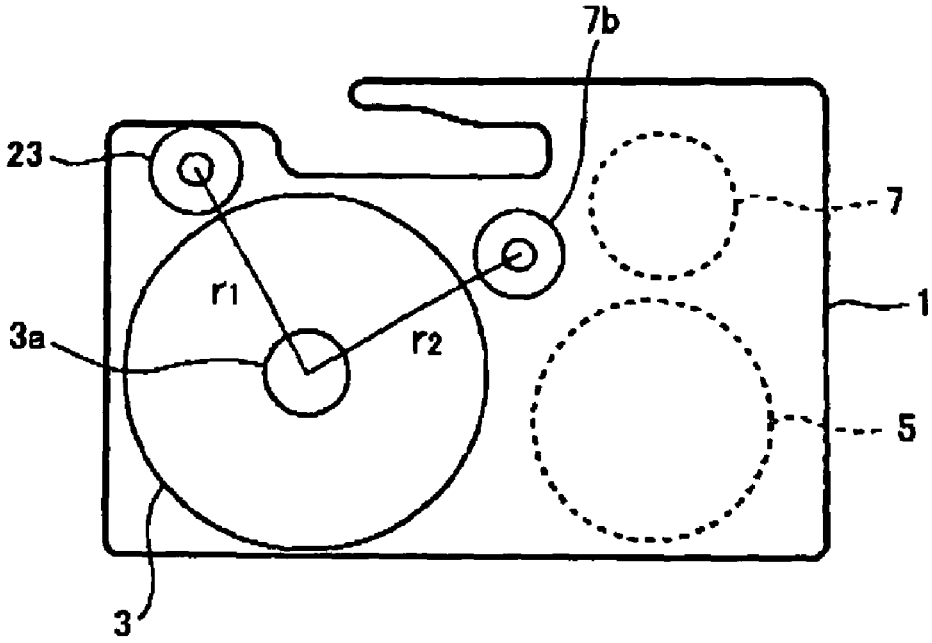
FIG. 7A is a plan view of a standard print medium cartridge according to an embodiment of the invention.

The differences between the standard cartridge 1 and the larger cartridge 200 will be described below by referring to FIG. 7.

The size of the standard cartridge 1 is defined depending on the distances among the double face tape spool 3*a* around which the double face tape 3 is wound, the tape feed roller 23 that is engaged with the tape feed roller. drive shaft 100*a*, and the ribbon take-up spool 7*b* that is engaged with the ribbon take-up spool drive shaft 100*b*. In the standard cartridge 1, for example, the position of the double face tape spool 3*a* is defined in such a way that the center of the double face tape spool 3*a* is separated from the center of the tape feed roller 23 by a distance r1 and separated from the center of the ribbon take-up spool 7*b* by a distance r2, as seen from FIG. 7A. Thus, the radius of the double face tape 3 wound around the double face tape spool 3*a* to occupy the largest space in the cartridge 1 is limited by the distances r1 and r2. Therefore, the total length of the multilayer tape 4 for a label that can be prepared from the cartridge 1 is limited by the distances r1, r2.

Figure 7B:
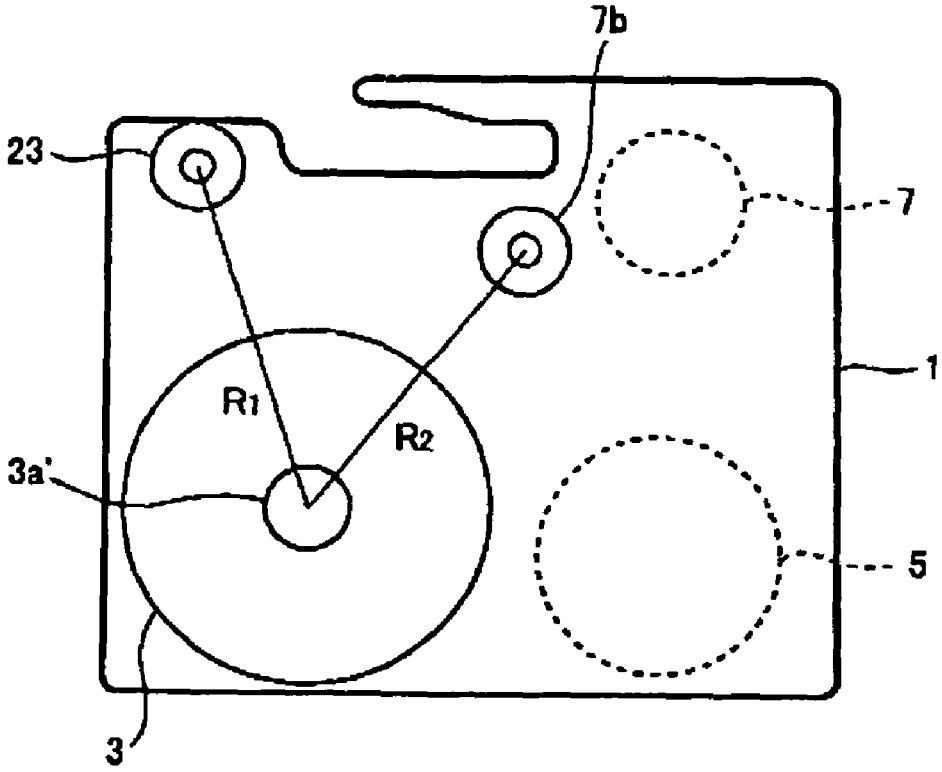
FIG. 7B is a plan view of a larger print medium cartridge according to an embodiment of the invention.

On the other hand, the size of the larger cartridge 200 is also defined depending on the distances among the double face tape spool 3*a*', the tape feed roller 23, and the ribbon take-up spool 7*b*, as seen from FIG. 7B. In the larger cartridge 200, the center of the double face tape spool 3*a*' is separated from the center of the tape feed roller 23 by a distance R1, and separated from the center of the ribbon take-up spool 7*b* by a distance R2. The position of the double face tape spool 3*a*' is determined in the larger cartridge 200 in such a way that the distance R1 between the centers of the double face tape spool 3*a*' and the tape feed roller 23 is longer than the distance r1 of the standard cartridge 1, and the distance R2 between the centers of the double face tape spool 3*a*' and the ribbon take-up spool 7 is longer than the distance r2 of the standard cartridge 1. Therefore, the radius of the double face tape 3 wound around the double face tape spool 3*a*' in the larger cartridge 200 can be longer than that of the double face tape 3 wound around the double face tape spool 3*a* in the standard cartridge 1 due to the above distances R1 and R2. Thus, if the multilayer tapes for a label contained in the cartridges 1 and 200 are of the same type, the total length of the multilayer tape in the cartridge 200 can be made longer than that of the multilayer tape in the cartridge 1.

While the distances R1, R2 in the larger cartridge 200 are respectively made longer than the corresponding distances r1, r2 in the standard cartridge 1 in this embodiment, the present invention is not limited to the above arrangement. When a different type of cartridge from that of the standard cartridge 1 is used, the distance between the centers of the double face tape spool and the tape feed roller, and the distance between the centers of the double face tape spool and the ribbon take-up spool may be respectively made shorter than the corresponding distances r1, r2 in the standard cartridge 1. In this case, the radius of the double face tape wound around the double face tape spool in the cartridge is made shorter than that of the double face tape wound around the double face tape spool in the standard cartridge.

Figure 6:
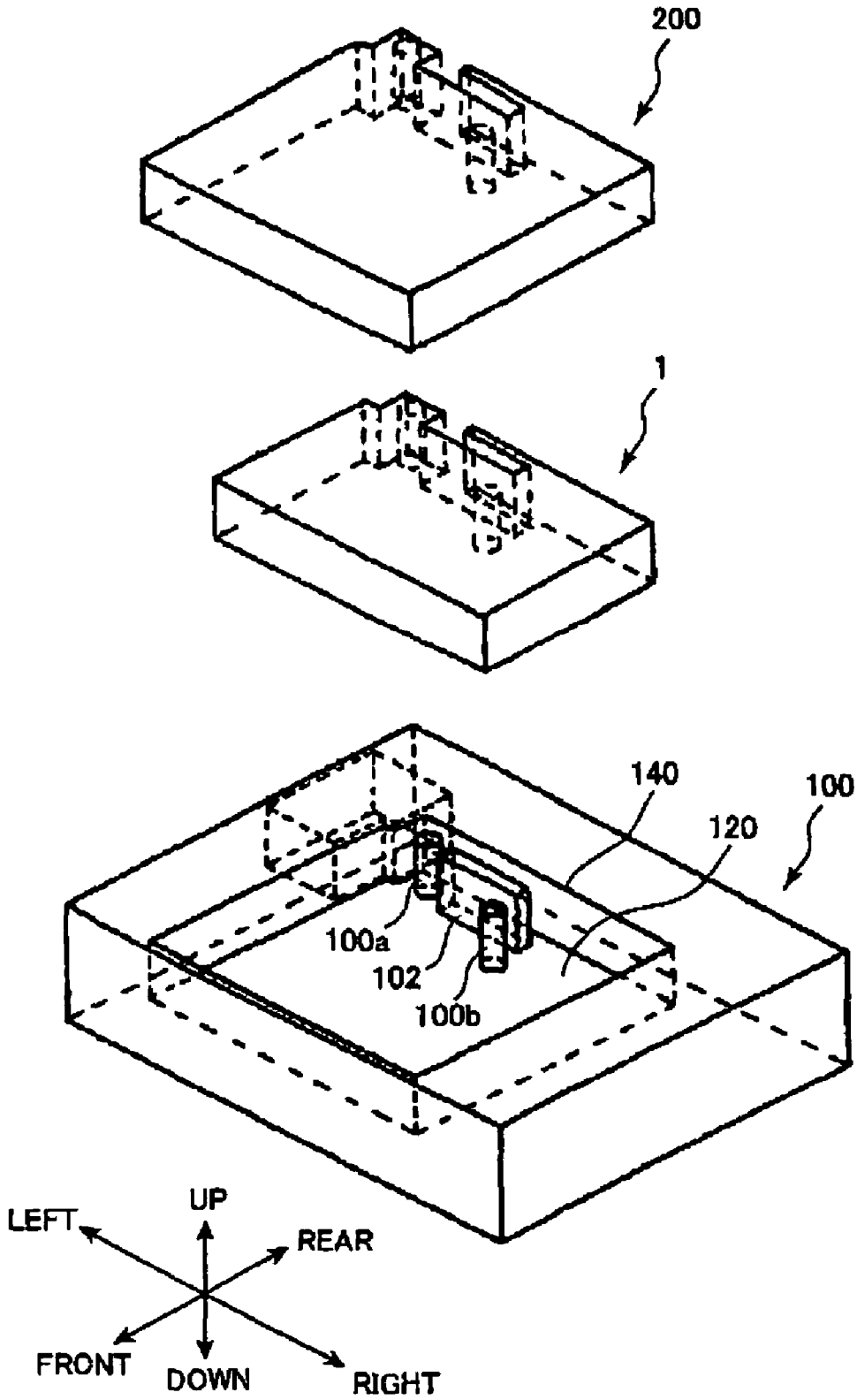
FIG. 6 is a perspective view of a printer according to the invention configured to selectively install one of a larger print medium cartridge and a standard print medium cartridge that have different width along a back and forth direction.

Referring to FIG. 6, the standard cartridge 1 and the larger cartridge 200 differ from each other in terms of the contour of the cross section perpendicular to the axis of winding of the print medium contained in the cartridge (in an up and down directions in FIGS. 2 and 5). The area of the larger cartridge 200 projected on a plane perpendicular to the above axial direction is larger than that of the standard cartridge 1 projected on the same plane. Thus, the cartridges 1 and 200 that are of different types differ from each other in terms of the distance between the tape spool 3*a* and the tape feed roller 23, the distance between the tape spool 3*a* and the ribbon take-up spool to reflect the difference between the contours of the cartridges.

Referring again to FIG. 6, a cartridge storage area 120 is formed in the tape printer 100 by inwardly (downwardly) forming a recess on the surface of the tape printer 100. The cartridge storage area 120 has an opening formed on the front surface whose plane is perpendicular to the upright direction of the tape printer 100. The opening is adapted to allow a larger cartridge 200 having a large contour perpendicular to the upright direction thereof relative to the corresponding contour of the standard cartridge 1 to pass therethrough. Differently stated, the cartridge storage area 120 has a size that is large sufficient to selectively accommodate one of the standard cartridge 1 and the larger cartridge 200 whose contours are different from each other. A cartridge installing section 140 is formed by the cartridge storage area 120 and the wall surfaces surrounding the cartridge storage area 120 (including four vertical wall surfaces and a horizontal bottom surface). The fixed printing head 102 and the drive shafts 100*a*, 100*b* of the tape printer 100 are arranged on and in the bottom surface of the cartridge installing section 140 to project into the cartridge storage area 120.

Each of the standard cartridge 1 and the larger cartridge 200 is respectively provided with insert sections at respective positions in order to insert the fixed printing head 102 and the drive shafts 100*a*, 100*b* of the tape printer 100. The position of the insert section is the same for both the standard cartridge 1 and the larger cartridge 200 in terms of the distances from the rear surface, the left lateral surface and the right lateral surface of the cartridges.

The fixed printing head 102 and the drive shafts 100*a*, 100*b* project upward from the bottom surface of the cartridge storage area 120 to access the standard cartridge 1 or the larger cartridge 200 to be installed in the tape printer 100 from below.

Therefore, the standard cartridge 1 and the larger cartridge 200 can be selectively installed into the tape printer 100. The standard cartridge 1 and the larger cartridge 200 establish an operational relationship with the fixed printing head 102 and the drive shafts 100*a*, 100*b*. In other words, the standard cartridge 1 and the larger cartridge 200 whose contours are different from each other can be selectively used for the printing. In other words, the fixed printing head 102 and the drive shafts 100*a*, 100*b* cooperate with both the standard cartridge 1 and the larger cartridge 200 for the printing.

Additionally, both the standard cartridge 1 and the larger cartridge 200 have a bottom that is made from transparent resin. Therefore, both the double face tape 3 and the print tape 5 can be optically detected for presence/absence or the remaining amount thereof by providing an optical sensor in the cartridge storage area 120. Such an optical sensor is typically a pair of a light emitting element and a light receiving element. The light emitting element emits light toward the double face tape 3 and the print tape 5 that are wound and stored in an standard cartridge 1 or a larger cartridge 200, which is installed in the cartridge storage area 120. The light receiving element detects light reflected from the double face tape 3 and light reflected from the print tape 5 to determine the remaining amounts of the tapes. The optical sensor operates detection of the tape properly in both the standard cartridge 1 and the larger cartridge 200.

The standard cartridge 1 and the larger cartridge 200 may be provided with respective marks indicating the type of the cartridge (standard or non-standard, laminate or non-laminate, etc.) at a position on the bottom surface of the cartridge that is identical for both the standard cartridge 1 and the larger cartridge 200. Therefore, the type and presence/absence of the cartridge may be detected by the optical sensor.

Thus, different types of cartridges may be provided for the tape printer 100 so that, if a user wants to prepare a multilayer tape by using a double face tape 3 and a print tape 5 that are long or thick per unit length, the user may install the larger cartridge 200 in the tape printer 100 to replace the standard cartridge 1 for the printing preparation (including selection of a text size, etc.) and the printing operation.

The cartridge storage area 120 extends in the frontward direction that is different from the extending direction of the ejecting section (leftward in the cartridge, or the tape ejecting hole 100*g* located leftward in the tape printer 100) of the standard cartridge 1 or the larger cartridge 200 stored in the cartridge storage area 120. The cartridge storage area 120 also extends in the direction that is different from the direction to the cutting device such as the cutting lever 110 and the rotary cutter 112.

The fixed printing head 102 and the drive shafts 100*a*, 100*b* are arranged rearward relative to the cartridge storage area 120. The insert sections for respectively inserting the fixed printing head 102 and the drive shafts 100*a*, 100*b* are located rearward in both the standard cartridge 1 and the larger cartridge 200. The larger cartridge 200 extends longer frontward compared with the standard cartridge 1.

Thus, while the contour of the larger cartridge 200 differs from that of the standard cartridge 1, the design of the insert sections for respectively inserting the fixed printing head 102 and the drive shafts 100*a*, 100*b* does not have to be modified. In other words, the larger cartridge 200 can be designed and manufactured with ease. Additionally, many parts can be commonly used for the standard cartridge 1 and the larger cartridge 200.

The above described embodiment can be modified or altered in may different ways without departing from the scope of the invention.

Figure 8:
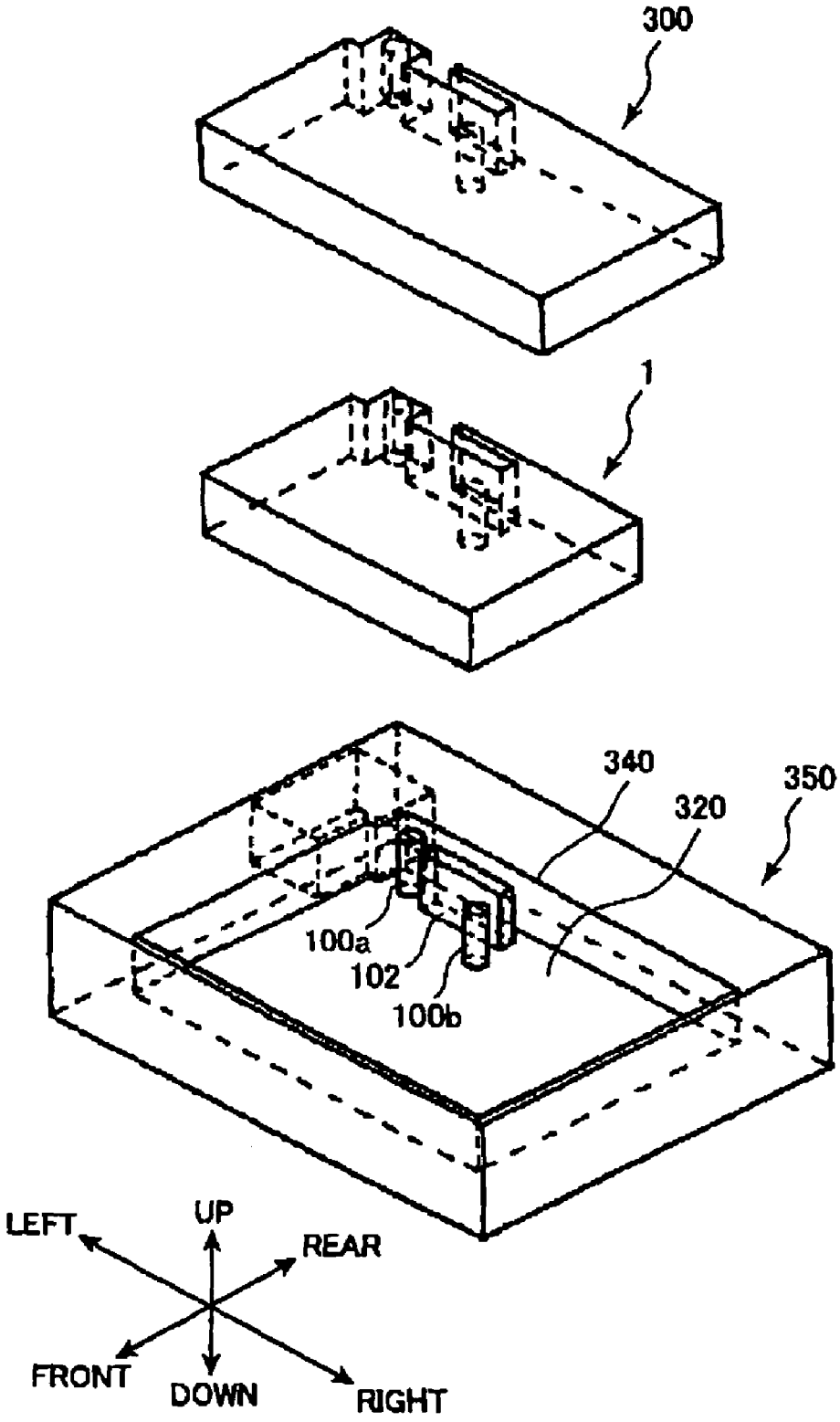
FIG. 8 is a perspective view of a printer of a modification according to the present invention which selectively use a larger print medium cartridge and a standard print medium cartridge that have different width along a left and right direction.

FIG. 8 shows another embodiment of the invention. Referring to FIG. 8, a larger cartridge 300 is made large compared with the standard cartridge 1, as the cartridge 300 extends in a right direction that is the opposite direction to the cutting device. With this embodiment again, the standard cartridge 1 and the larger cartridge 300 can be selectively installed in the tape printer 350 so as to receive the fixed printing head 102 and the drive shafts 100*a*, 100*b*. In other words, the standard cartridge 1 and the larger cartridge 300 having respective contours different from each other can be selectively used with the tape printer 350 for the printing.

As shown in FIG. 8, in a tape printer 350 that is adapted to use the standard cartridges 1 and the large cartridges 300, a cartridge storage area 320 and a cartridge mounting section 340 are extended rightward so as to be able to store a larger cartridge 300.

Figure 9:
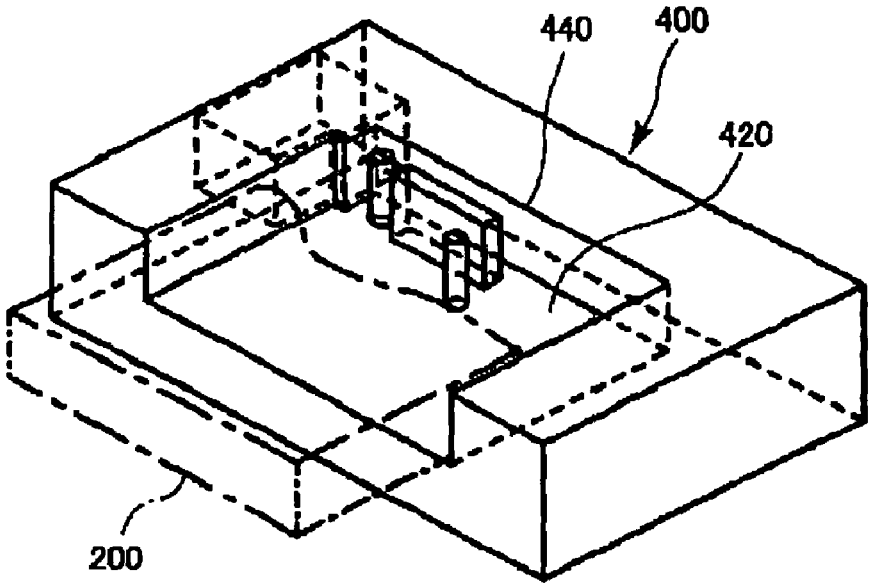
FIG. 9 is a perspective view of a printer of a modification of the present invention that installs a larger print medium cartridge.

Alternatively, a cartridge storage area 420 and a cartridge mounting section 440 may be configured so that the larger cartridge 200 projects forward out of the tape printer 400 (in the direction opposite to the side where the fixed printing head 102 and the drive shafts 100*a*, 100*b* are arranged) as indicated by dotted broken lines in FIG. 9. In this case again, the standard cartridge 1 and the larger cartridge 200 can be selectively installed in the tape printer 400 so as to access the fixed printing head 102 and the drive shafts 100*a*, 100*b*. In other words, the tape printer is adapted to selectively install either one of the standard cartridge 1 and the larger cartridge 200 having respective contours that are different from each other for the printing. It is noted that the cartridge storage area 420 and the cartridge installing section 440 are forwardly and backwardly so dimensioned that the standard cartridge 1 can be stored in the cartridge storage area 420 without projecting out of the tape printer 400.

Additionally, while the tape printer 400 of FIG. 9 is so configured that the larger cartridge 200 projects forward, the tape printer 350 may be dimensionally reduced at the right side to make the tape printer 350 have a relatively short width in the rightward and leftward directions. The cartridge storage area 320 and the cartridge installing section 340 may be configured so that the larger cartridge 300 installed in the tape printer 350 projects rightward out of the tape printer 350 as shown in FIG. 8.

Figure 10:
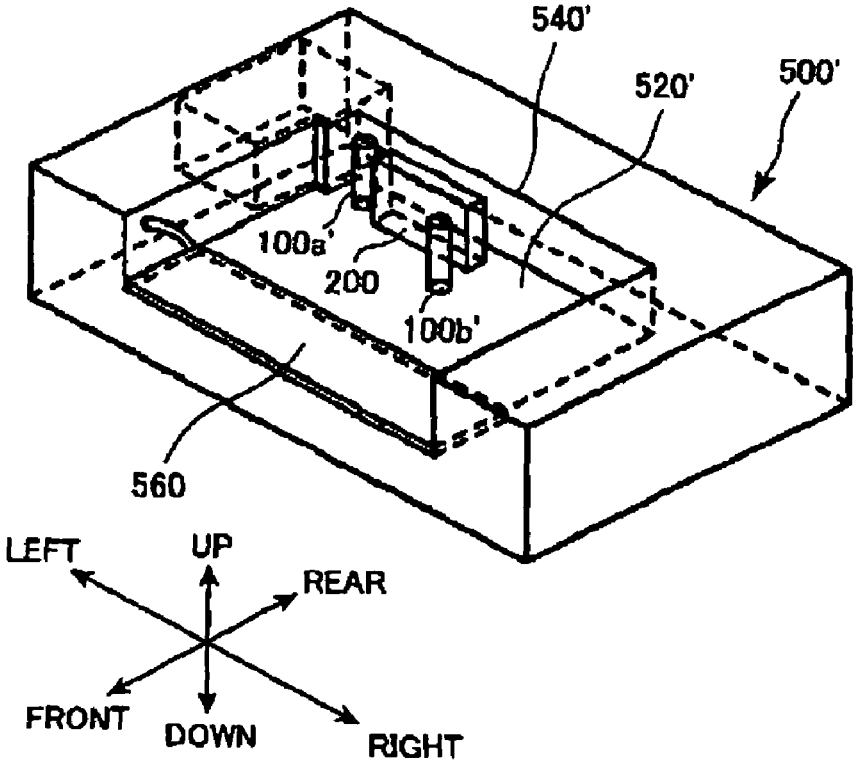
FIG. 10 is a perspective view of a printer according to the present invention which has a closing member and allows a larger print medium cartridge to be installed and partly be projected out of the printer.

As described above, in the arrangement where the larger cartridge 200 projects out of the tape printer 500, an opening may be formed at the tape printer 500 to allow the larger cartridge 200 to project out of the tape printer 500, if necessary. Therefore, a movable cover member 560 may be arranged at the front wall of a cartridge storage area 520 of the tape printer 500 as shown in FIG. 10.

In the case of a tape printer 500 provided with an movable cover member 560, the cover member 560 can be rotated backward around the rotary axis arranged along the lower end of the cover member 560. Therefore, the cover member 560 is held standing vertically when the standard cartridge 1 is installed in the cartridge storage area 520 of the tape printer 500, whereas the cover member 560 is turned backward to produce an opening when the larger cartridge 200 is installed in the cartridge storage area 520 of the tape printer 500.

With this arrangement, a user manually manipulates the cover member 560. In order to hold the cover member 560 in the upright position, the cover member 560 may be provided at the left and right ends with projections projecting leftward and rightward respectively. The lateral walls of the cartridge storage area 520 of the tape printer 500 may be provided at the corresponding positions with recesses for respectively receiving the projections.

The tape printer 500 may be provided with a recess into which the cover member 560 can be accommodated.

The tape printer 500 may be provided at a frontward position of the bottom surface of a cartridge installing section 540 with a recess 570 having a depth equal to the thickness of the cover member 560. Then, the cover member 560 lies flat in the recess 570 when it is turned. Therefore, the standard cartridge 1 and the larger cartridge 200 can be selectively installed in the cartridge storage area 520. Additionally, the left and right lateral walls of the cartridge installing section 540 may be provided with respective arc-shaped grooves 580 that match the track of movement of the corresponding projections for holding the cover member 560 in the upright position. Engagement sections may be formed respectively at the top ends of the grooves 580 for the corresponding projections.

Figure 11:
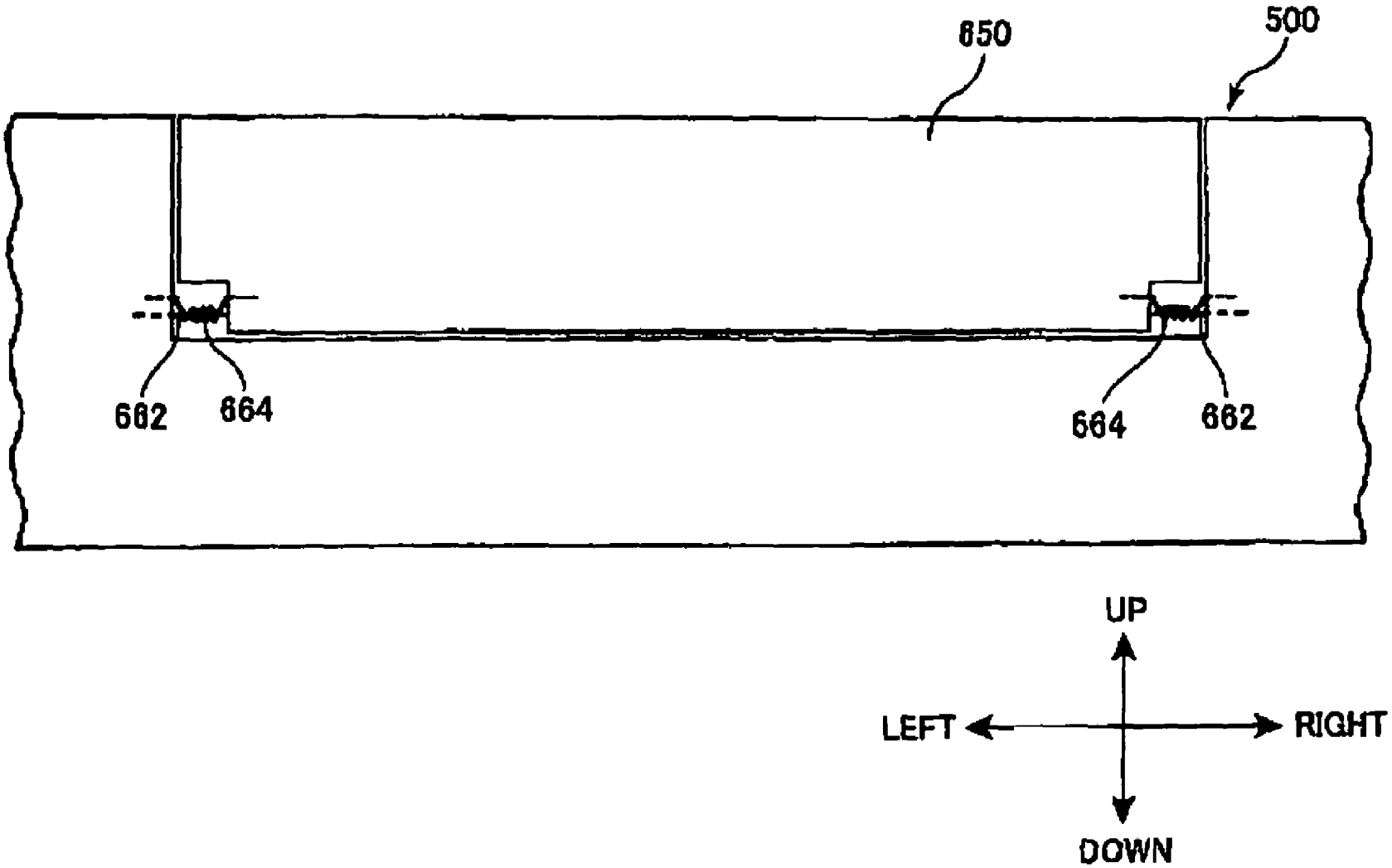
FIG. 11 is a schematic front view of a printer according to the invention which is provided with a closing member and coil springs so as to allow a larger print medium cartridge to be installed and be projected out of the printer.
Figure 12:
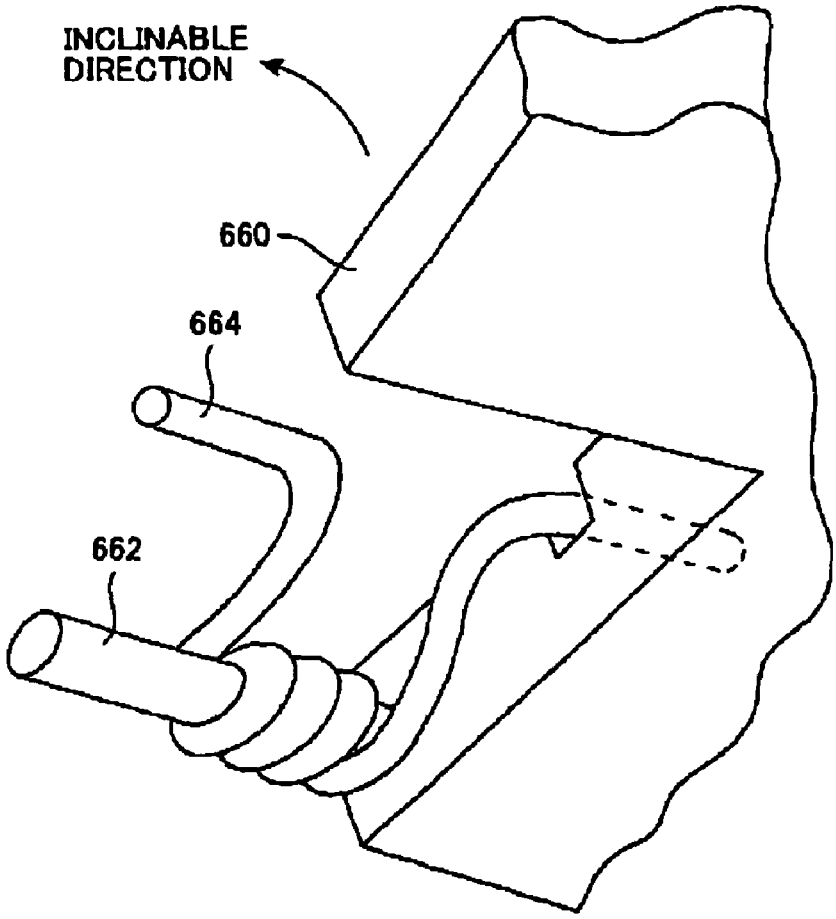
FIG. 12 is an enlarged view of the coil spring shown in FIG. 11.
Figure 13:
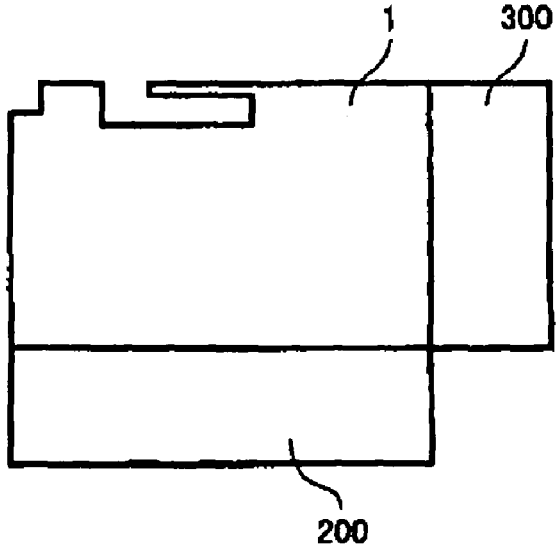
FIG. 13 is a view showing outlines of a larger print medium cartridge and a standard print medium cartridge.

While a user may manually move the cover member 560 into the flat position or the upright position as described above, the cover member 560 may alternatively be arranged so that its movement is interlocked with the installation of the larger cartridge 200 to the tape printer 500. For example, a cover member 660 may be notched at the lower left and at the lower right corner and provided with respective spindles 662 projecting leftward and rightward. The spindles 662 are respectively held to lower front positions of the left and right walls of the cartridge installing section 540 in order to rotate freely as shown in FIG. 11. Coil springs 664 are arranged respectively around the spindles 662. Each of the coil springs 664 is hooked to the cover member 660 with the end thereof. Each of the coil springs 664 is hooked with the other end to a lower front position of the left or right lateral wall of the cartridge installing section 540. Therefore, the coil spring 664 urges the cover member 560 to pivotably rotate counterclockwise as viewed from the right side of the cover member 560. With this arrangement, the cover member 560 is pushed to rotate and lie down when the larger cartridge 200 is moved from the front side to the rear side, which is convenient for the user.

While the cover member 560 can be pivotably rotated and lie down in the above description, a removable cover member from the tape printer 500 may be alternatively used. If the cover member 560 is not removed from the tape printer 500, the cover member 560 is free from being lost.

In the above described embodiment, the printer 100 and the cartridges 1, 200 are adapted to print on the print tape 5 that is arranged under the suppermost laminate layer. However, the present invention is also applicable to a printer adapted to prepare a tape for non-laminate labels on which the uppermost layer is a print tape without any laminate layer. An standard cartridge and a larger cartridge may be provided as replacements for supplying a double face tape 3 and a print tape 5 when the current double face tape 3 and the current print tape 5 are run short.

INDUSTRIAL APPLICABILITY

The present invention is applicable for many types of printers for printing on a tape for labels.

The invention claimed is:

1. A printer comprising:

a printing head that prints on a print medium;

a print medium drive mechanism that moves the print medium relative to the printing head; and an installation section having a rectangular storage area in which a first print medium cartridge and a second print medium cartridge are selectively installable, each of the first print medium cartridge and the second print medium cartridge containing the print medium wound around a winding axis, the first print medium cartridge having a first rectangular shape having a first longitudinal axis, the second print medium cartridge having a second rectangular shape having a second longitudinal axis, the second longitudinal axis being longer than the first longitudinal axis to form a different outline of a cross section perpendicular to the winding axis from that of the first print medium cartridge, the first print medium cartridge including a pair of two side faces opposing each other and a bottom surface between the two side faces along the first longitudinal axis, the second print medium cartridge including a pair of two side faces opposing each other and a bottom surface between the two side faces along the second longitudinal axis, and the bottom surface of the first print medium cartridge and the bottom surface of the second print medium cartridge being completely within the rectangular storage area when either of the first print medium cartridge or the second print medium cartridge is installed in the installation section.

2. The printer according to claim 1, further comprising:

a detector provided in the installation section, wherein the detector detects at least one of presence or absence of the print medium cartridge in the storage area, presence or absence of the print medium in the print medium cartridge if the print medium cartridge is stored in the storage area, and the type of the print medium.

3. The printer according to claim 1, further comprising cutting means provided on a side from which the print medium in the print medium cartridge installed in the storage area is ejected, wherein the storage area extends in an opposite direction to the side of cutting means.

4. The printer according to claim 1, wherein:

the print medium drive mechanism comprises a rotary shaft to be connected to one of the first and second print medium cartridges to move the print medium relative to the printing head, the first print medium cartridge comprises a first portion to receive the rotary shaft and the printing head, the second print medium cartridge comprises a second portion to receive the rotary shaft and the printing head, and the first portion and the second portion have a common shape.

5. The printer according to claim 1, wherein:

the storage area is defined by a bottom face and three inner side faces around the bottom face, the printing head projects from the bottom face adjacent to one of the three inner side faces into the storage area, and the printing head is positioned near one of the pair of two side faces of one of the first and second print medium cartridges when the one of the first and second print medium cartridges is installed in the storage area.

6. The printer according to claim 1, wherein:

the storage area is defined by a bottom face and three inner side faces around the bottom face, the printing head projects from the bottom face adjacent to one of the three inner side faces into the storage area, each of the first and second print medium cartridges has another pair of side faces opposing to each other, and the printing head is positioned near one of the another pair of side faces of one of the first and second print medium cartridges when the one of the first and second print medium cartridges is installed in the storage area.

7. A printer in which a first print medium cartridge and a second print medium cartridge are selectively installable, both of the print medium cartridges containing a print medium wound around a winding axis, comprising:

a printing head that prints on the print medium;

a print medium drive mechanism that moves the print medium relative to the printing head; and an installation section having a rectangular section in which the one of the first print medium cartridge and the second print medium cartridge is selectively installed, and an opening through which one of the first and second print medium cartridges in the rectangular section is projected out, the first print medium cartridge having a first rectangular shape having a first longitudinal axis, the second print medium cartridge having a second rectangular shape having a second longitudinal axis, the second longitudinal axis being longer than the first longitudinal axis to form a different outline of a cross section perpendicular to the winding axis from that of the first print medium cartridge, the first print medium cartridge including a pair of two side faces opposing each other and a bottom surface between the two side faces along the first longitudinal axis, the second print medium cartridge including a pair of two side faces opposing each other and a bottom surface between the two side faces along the second longitudinal axis, and the bottom surface of the first print medium cartridge and the bottom surface of the second print medium cartridge being completely within the rectangular storage area when either of the first print medium cartridge or the second medium cartridge is installed in the installation section.

8. The printer according to claim 7, wherein:

the print medium drive mechanism comprises a rotary shaft to be connected to one of the first and second print medium cartridges to move the print medium relative to the printing head, the first print medium cartridge comprises a first portion to receive the rotary shaft and the printing head, the second print medium cartridge comprises a second portion to receive the rotary shaft and the printing head, and the first portion and the second portion have a common shape.

9. The printer according to claim 7, wherein:

the receiving section is defined by a bottom face and three side faces around the bottom face, the printing head projects from the bottom face adjacent to one of the three inner side faces into the receiving section, and the printing head is positioned near one of the pair of two side faces of one of the first and second print medium cartridges when the one of the first and second print medium cartridges is installed in the receiving section.

10. The printer according to claim 7, wherein:

the receiving section is defined by a bottom face and three side faces around the bottom face, the printing head projects from the bottom face adjacent to one of the three inner side faces into the receiving section, each of the first and second print medium cartridges has another pair of two side faces opposing to each other, and the printing head is positioned near one of the another pair of two side faces of one of the first and second print medium cartridges when the one of the first and second print medium cartridges is installed in the receiving section.

11. A printer comprising:

a printer main unit having a printing head that prints on a print medium;

a print medium drive mechanism that moves the print medium relative to the printing head; and an installation section having a rectangular storage area to be selectively installed either one of a first print medium cartridge and a second print medium cartridge, the first print medium cartridge containing a first print medium in a wound state, the first print medium being strip-shaped, the first print medium cartridge having a first rectangular shape having a first longitudinal axis, the first print medium cartridge including a pair of two side faces opposing each other and a bottom surface between the two side faces along the first longitudinal axis, the second print medium cartridge containing a second print medium in a wound state, the second print medium cartridge being strip-shaped, the second print medium cartridge having a second rectangular shape having a second longitudinal axis, the second longitudinal axis being longer than the first longitudinal axis to form a different outline of a cross section perpendicular to a winding axis thereof from that of the first print medium in the wound state, the second print medium cartridge including a pair of two side faces opposing each other and a bottom surface between the two side faces along the second longitudinal axis, the bottom surface of the first print medium cartridge and the bottom surface of the second print medium cartridge being completely within the rectangular storage area when either of the first print medium cartridge or the second print medium cartridge is installed in the installation section, and the printing head being arranged adjacent to one of the side faces of the one print medium cartridge so as to print on the print medium in the one print medium cartridge installed in the storage area, and the print medium drive mechanism being arranged so as to move the print medium in the print medium cartridge installed in the storage area.

12. The printer according to claim 11, wherein:

the print medium drive comprises a rotary shaft to be connected to one of the first and second print medium cartridges to move the print medium relative to the printing head, the first print medium cartridge comprises a first portion to receive the rotary shaft and the printing head, the second print medium cartridges comprises a second portion to receive the rotary shaft and the printing head, and the first portion and the second portion have a common shape.

13. The printer according to claim 11, wherein:

the rectangular storage area is defined by a bottom face and three inner side faces around the bottom face, the printing head projects from the bottom face adjacent to one of three inner side faces into the storage area, and the printing head is positioned near one of the pair of two side faces of one of the first and second print medium cartridges when the one of the first and second print medium cartridges is installed in the storage area.

14. The printer according to claim 11, wherein:

the rectangular storage area is defined by a bottom face and three inner side faces around the bottom face, the printing head projects from the bottom face adjacent to one of three inner side faces into the storage area, each of the first and second print medium cartridges has another pair of side faces opposing to each other, and the printing head is positioned near one of the another pair of two side faces of one of the first and second print medium cartridges when the one of the first and second print medium cartridges is installed in the storage area.

15. A printer comprising a printing main unit and at least one of a standard cartridge and a non-standard cartridge installable into the printing main unit, the standard cartridge including a print medium, the printing main unit comprising:

a printing head that prints on the print medium;

print medium drive mechanism having a first rotary shaft and a second rotary shaft rotating in synchronism with the first rotary shaft, thereby moving the print medium relative to the printing head; and an installation section having a rectangular storage area configured such that the standard cartridge and the non-standard cartridge are selectively installable, the standard cartridge having a first rectangular shape having a first longitudinal axis, the standard cartridge including a pair of two side faces opposing each other and a bottom surface between the two side faces along the first longitudinal axis, and comprising:

a rotatable standard spool around which the print medium is wound, the standard spool having a standard spool rotating center;

a first roller configured to be engaged with the first rotary shaft to move the print medium, the first roller having a first rotating center; and a second roller configured to be engaged with the second rotary shaft, the second roller having a second rotating center; the standard spool rotating center being separated from the first rotating center by a first predetermined distance (r1), and the standard spool rotating center being separated from the second rotating center by a second predetermined distance (r2); the standard cartridge being replaceable with a non-standard cartridge, the non-standard cartridge having a second rectangular shape having a second longitudinal axis, the non-standard cartridge including a pair of two side faces opposing each other and a bottom surface between the two side faces along the second longitudinal axis, and the second longitudinal axis being longer than the first longitudinal axis, comprising:

a rotatable non-standard spool around which the print medium is wound, the non-standard spool having a non-standard spool rotating center;

a third roller configured to be engaged with the first rotary shaft to move the print medium, the third roller having a third rotating center; and a fourth roller configured to be engaged with the second rotary shaft, the fourth roller having a fourth rotating center; a distance (R1) between the non-standard spool rotating center and the third rotating center being different from the first predetermined distance (r1), and a distance (R2) between the non-standard spool rotating center and the fourth rotating center being different from the second predetermined distance (r2), the bottom surface of the standard cartridge and the bottom surface of the non-standard cartridge being completely within the rectangular storage area when either of the standard cartridge or the non-standard cartridge is installed in the installation section.

16. The printer according to claim 15, wherein the distance (R1) is longer than the first predetermined distance (r1), and the distance (R2) is longer than the second predetermined distance (r2).

17. The printer according to claim 15, wherein:

the standard cartridge comprises a first portion to receive the printing head, the standard cartridge having a first positional relationship between the first portion, the first roller, and the second roller, and the non-standard print medium cartridge comprises a second portion to receive the printing head, the non-standard cartridge having a second positional relationship among the second portion, the third roller, and the fourth roller, the first positional relationship and the second positional relationship are identical.

18. A non-standard cartridge installable to a printer having a printing head for printing a print medium and a print medium drive mechanism, the print medium drive mechanism including a first rotary shaft and a second rotary shaft that rotates in synchronism with the first rotary shaft to move the print medium relative to the printing head, the standard cartridge having a first rectangular shape having a first longitudinal axis, the standard cartridge including a pair of side faces opposing each other and a bottom surface between the two side faces alone the first longitudinal axis, comprising:

a rotatable standard spool around which the print medium is wound, the standard spool having a standard spool rotating center;

a first roller configured to be engaged with the first rotary shaft to move the print medium, the first roller having a first rotating center; and a second roller configured to be engaged with the second rotary shaft, the second roller having a second rotating center, the standard spool rotating center being separated from a the first rotating center by a first predetermined distance (r1), and separated from the second rotating center by a second predetermined distance (r2), the non-standard cartridge having a second rectangular shape having a longitudinal axis, the non-standard cartridge including a pair of two side faces opposing each other and a bottom surface between the two side faces along the second longitudinal axis, and the second longitudinal axis being longer than the first longitudinal axis, comprising:

a rotatable non-standard spool around which the print medium is wound, the non-standard spool having a non-standard spool rotating center;

a third roller configured to be engaged with the first rotary shaft to move the print medium, the third roller having a third rotating center; and a fourth roller configured to be engaged with the second rotary shaft, the fourth roller having a fourth rotating center; a distance (R1) between the non-standard spool rotating center and the third rotating center being different from the first predetermined distance (r1), a distance (R2) between the non-standard spool rotating center and the fourth rotating center being different from the second predetermined distance (r2), wherein the non-standard cartridge is replaceable with a standard cartridge installable for the printer, the bottom surface of the standard cartridge and the bottom surface of the non-standard cartridge being completely within the rectangular storage area when either of the standard cartridge or the non-standard cartridge is installed in the installation section.

19. The non-standard cartridge according to claim 18, wherein the distance (R1) is longer than the first predetermined distance (r1), the distance (R2) is longer than the second predetermined distance (r2).

20. The non-standard cartridge according to claim 18, wherein:

the standard cartridge comprises a first portion to receive the printing head, the standard cartridge having a first positional relationship between the first portion, the first roller, and the second roller, and the non-standard print medium cartridge comprises a second portion to receive the printing head, the non-standard cartridge having a second positional relationship among the second portion, the third roller, and the fourth roller, the first positional relationship and the second positional relationship are identical.

21. A printer, comprising:

a printing head that prints on a print medium;

a print medium drive mechanism that moves the print medium relative to the printing head; and an installation section including a storage area in which a first print medium cartridge and a second print medium cartridge that have different volumes, are selectively installable, the storage area having a sufficient volume to completely accommodate a bottom surface of a larger of the first print medium cartridge and the second print medium cartridge, the first print medium cartridge having a first rectangular shape having a first longitudinal axis, the first print medium cartridge including a pair of two side faces opposing each other and a bottom surface between the two side faces along the first longitudinal axis, and the second print medium cartridge having a second rectangular shape having a second longitudinal axis, the second longitudinal axis being longer than the first longitudinal axis to form a different outline of a cross section perpendicular to a winding axis from that of the first print medium cartridge, the second print medium cartridge including a pair of two side faces opposing each other and a bottom surface between the two side faces along the second longitudinal axis, and the bottom surface of the first print medium cartridge and the bottom surface of the second print medium cartridge being completely within the rectangular storage area when either of the first print medium cartridge or the second print medium cartridge is installed in the installation section.

22. The printer according to claim 21, wherein:

the print medium drive mechanism comprises a rotary shaft to be connected to one of the first and second print medium cartridges to move the print medium relative to the printing head, the first print medium cartridge comprises a first portion to receive the rotary shaft and the printing head, the second print medium cartridge comprises a second portion to receive the rotary shaft and the printing head, and the first portion and the second portion have a common shape.

23. The printer according to claim 21, wherein:

the storage area is defined by a bottom face and three side faces around the bottom face, the printing head projects from the bottom face adjacent to the one of the three side faces into the storage area, and the printing head is positioned near one of the pair of two side faces of one of the first and second print medium cartridges when the one of the first and second print medium cartridges is installed in the storage area.

24. The printer according to claim 21, wherein:

the storage area is defined by a bottom face and three side faces around the bottom face, the printing head projects from the bottom face adjacent to the one of the three side faces into the storage area, each of the first and second print medium cartridges has another pair of side faces opposing to each other, and the printing head is positioned near one of the another pair of two side faces of one of the first and second print medium cartridges when the one of the first and second print medium cartridges is installed in the storage area.

25. A printer, comprising:

a printing head that prints on a print medium;

a print medium drive mechanism that moves the print medium relative to the printing head; and an installation section including a rectangular storage area in which a first print medium cartridge and a second print medium cartridge that have different volumes, are selectively installable, the storage area having a volume to accommodate a smaller of the first and second print medium cartridges such that at least a part of the larger of the first print medium cartridge and the second print medium cartridge protrudes from at least one of the storage area and the printer when installed, each of the first print medium cartridge and the second print medium cartridge containing the print medium wound around a winding axis, the first print medium cartridge having a first rectangular shape including a first longitudinal axis, the first print medium cartridge including a pair of two side faces opposing each other and a bottom surface between the two side faces along the first longitudinal axis, the second print medium cartridge having a second rectangular shape having a second longitudinal axis, the second longitudinal axis being longer than the first longitudinal axis to form a different outline of a cross section perpendicular to the winding axis from that of the first print medium cartridge, the second print medium cartridge including a pair of two side faces opposing each other and a bottom surface between the two side faces along the second longitudinal axis, and the bottom surface of the first print medium cartridge and the bottom surface of the second print medium cartridge being completely within the rectangular storage area when either of the first print medium cartridge or the second print medium cartridge is installed in the installation section.

26. The printer according to claim 25, further comprising:

a cover member provided in a wall of the storage area, wherein the cover member encloses the smaller of the cartridges when the smaller cartridge is installed, and is opened to provide an opening for installing the larger of the cartridges and is maintained open when the larger of the cartridges is installed.

27. The printer according to claim 25, wherein:

the print medium drive mechanism comprises a rotary shaft to be connected to one of the first and second print medium cartridges to move the print medium relative to the printing head, the first print medium cartridge comprises a first portion to receive the rotary shaft and the printing head, the second print medium cartridge comprises a second portion to receive the rotary shaft and the printing head, and the first portion and the second portion have a common shape.

28. The printer according to claim 25, wherein:

the storage area is defined by a bottom face and three inner side faces around the bottom face, the printing head projects from the bottom face adjacent to one of the three inner side faces into the storage area, and the printing head is positioned near one of the pair of two side faces of one of the first and second print medium cartridges when the one of the first and second print medium cartridges is installed in the storage area.

29. The printer according to claim 25, wherein:

the storage area is defined by a bottom face and three inner side faces around the bottom face, the printing head projects from the bottom face adjacent to one of the three inner side faces into the storage area, each of the first and second print medium cartridges has another pair of side faces opposing to each other, and the printing head is positioned near one of the another pair of two side faces of one of the first and second print medium cartridges when the one of the first and second print medium cartridges is installed in the storage area.

* * * * *